US007128121B2

(12) United States Patent
Nien

(10) Patent No.: US 7,128,121 B2
(45) Date of Patent: Oct. 31, 2006

(54) FABRIC WINDOW BLIND

(75) Inventor: Ming Nien, Changhua Hsien (TW)

(73) Assignee: Nien Made Enterprises Co., Ltd., Taichung (TW)

( * ) Notice: Subject to any disclaimer, the term of this patent is extended or adjusted under 35 U.S.C. 154(b) by 209 days.

(21) Appl. No.: 10/901,128

(22) Filed: Jul. 29, 2004

(65) Prior Publication Data

US 2005/0194104 A1 Sep. 8, 2005

(30) Foreign Application Priority Data

Mar. 5, 2004 (TW) ..... 93203376 U

(51) Int. Cl.
*E06B 9/08* (2006.01)
*E06B 3/32* (2006.01)

(52) U.S. Cl. ..... 160/121.1; 160/89; 160/85

(58) Field of Classification Search ..... 160/89, 160/85, 121.1, 168.1 R, 173 R, 86
See application file for complete search history.

(56) References Cited

U.S. PATENT DOCUMENTS 3,384,519 A * 5/1968 Froget ..... 156/65
4,019,554 A * 4/1977 Rasmussen ..... 160/84.02
4,577,179 A * 3/1986 Chambers et al. ..... 340/309.8
5,285,838 A * 2/1994 Rapp et al. ..... 160/168.1 R
5,419,385 A * 5/1995 Vogel et al. ..... 160/121.1
5,454,414 A * 10/1995 Colson et al. ..... 160/84.02
5,664,613 A * 9/1997 Jelic ..... 160/84.05
6,006,813 A * 12/1999 Jelic ..... 160/107
6,189,592 B1 * 2/2001 Domel ..... 160/85
6,431,246 B1 * 8/2002 Peterson ..... 160/168.1 R
6,688,370 B1 * 2/2004 Nien ..... 160/121.1
D493,650 S * 8/2004 Tuzmen ..... D6/575
6,910,516 B1 * 6/2005 Huang ..... 160/170

* cited by examiner

*Primary Examiner*—Hugh B. Thompson, II
*Assistant Examiner*—Candace L. Bradford
(74) *Attorney, Agent, or Firm*—Birch, Stewart, Kolasch & Birch, LLP.

(57) ABSTRACT

A fabric window blind includes a head frame, a roller, an adjustment mechanism, slats, a bottom rail and a light-admitting shade. The roller is horizontally rotatably mounted inside the head frame. The adjustment mechanism has a control axle horizontally pivotally mounted inside the head frame below the roller, and two cord member sets having top ends connected to the control axle and bottom ends vertically downwardly suspended from the control axle. The slats are arranged at different elevations below the control axle. The slats each have two opposite lateral sides respectively joined to the cord member sets. The bottom rail is fastened to the bottom ends of the cord member sets below the slats. The shade has a first end fastened to the head frame, and a second end extended downwardly over the bottom rail and turned upwards toward the head frame and fastened to the roller.

24 Claims, 6 Drawing Sheets

FABRIC WINDOW BLIND

This Non-provisional application claims priority under 35 U.S.C. § 119(a) on Patent Application No(s). 093203376 filed in Taiwan, Republic of China on Mar. 5, 2004, the entire contents of which are hereby incorporated by reference.

BACKGROUND OF THE INVENTION

1. Field of the Invention

The present invention relates to a fabric window blind and more particularly, to a double-layer fabric roller blind.

2. Description of the Related Art

FIGS. 1 and 2 show a conventional roller blind. This structure of roller blind 1 comprises a cylindrical roller 2 horizontally affixed to the top side of a window and rotatable manually or by means of electric driving means, a bottom rail 3 spaced below the roller 2, a plurality of soft slats 4 arranged in parallel at different elevations between the roller 2 and the bottom rail 3, each soft slat 4 having two opposite long sides respectively hemmed with a support rod 5, two cord member sets 6 arranged in parallel near two lateral sides, each cord member set 6 having a front cord 7 and a rear cord 8 respectively connected between the roller 2 and the bottom rail 3 and joined to the two opposite long sides of each slat 4, and two shades 9 respectively vertically arranged at the front and back sides of the roller blind 1 and respectively connected between the roller 2 and the bottom rail 3. The shades 9 have a proper light transmittance (for example, made of gauze cloth). The size of the shades 9 is approximately equal to the size of the window.

By means of the aforesaid arrangement, the slats 9 are covered over the front and back side of the shades 4 to filter light and to decorate the roller blind 1. After the roller blind 1 has been fully extended out, the user can rotate the roller 2 to move the front cord 7 and rear cord 8 of each cord member set 6 in reversed directions to further tilt the slats 4. Further, when continuously rotate the roller 2 forwards or backwards, the roller 2 is forced to roll up the slats 4 with the support rods 5 and the shades 9, as shown in FIG. 2, and therefore the roller blind can be received to the top side of the window, and positioned in the desired elevational position to block a part of the window.

The aforesaid roller blind 1 is still not satisfactory in function. When rotating the roller 2 to receive the slats 4 with the support rods 5 and the cord member sets 6 as well as the shades 9 to the periphery of the roller 2, the rolled-up size is greatly increased. In order to receive the rolled-up structure of the roller 2, slats 4, support rods 5, cord member sets 6 and shades 9, the size (transverse width of the head frame) must be relatively increased. Installing a bulky head frame in the top side of a window destroy the sense of beauty of the window. When rotating the roller 2 to roll up the slats 4 with the support rods 5, the cord member sets 6 and the shades 9, the shades 9 are wrapped on the support rods 5 and the cord member sets 6 and caused to wrinkle. Further, because the cord member sets are fastened to the roller 2, the user can rotate the roller 2 to tilt the slats 4 only when the roller blind 1 has been fully extended out. If the roller blind 1 is rolled up to a desire elevation, i.e. the slats 4 are received in a vertical position between the shades 9, the user cannot adjust the tilting angle of the received slats 4.

SUMMARY OF THE INVENTION

The present invention has been accomplished under the circumstances in view. It is the primary objective of the present invention to provide a fabric window blind, which reduces the volume of the head frame for receiving the rolled-up shades.

It is another objective of the present invention to provide a fabric window blind, which keeps the shade from wrinkling.

It is still another object of the present invention to provide a fabric window blind, which allows the user to adjust the tilting angle of the slats at any position.

To achieve these objectives of the present invention, the fabric window blind comprises a head frame, a roller, an adjustment mechanism, slats, a bottom rail and a light-admitting shade. The roller is horizontally rotatably mounted inside the head frame. The adjustment mechanism has a control axle horizontally pivotally mounted inside the head frame below the roller, and two cord member sets having top ends connected to the control axle and bottom ends vertically downwardly suspended from the control axle. The slats are arranged at different elevations below the control axle. The slats each have two opposite lateral sides respectively joined to the cord member sets. The bottom rail is fastened to the bottom ends of the cord member sets below the slats. The shade has a first end fastened to the head frame, and a second end extended downwardly over the bottom rail and turned upwards toward the head frame and fastened to the roller.

DETAILED DESCRIPTION OF THE INVENTION

Figure 1:
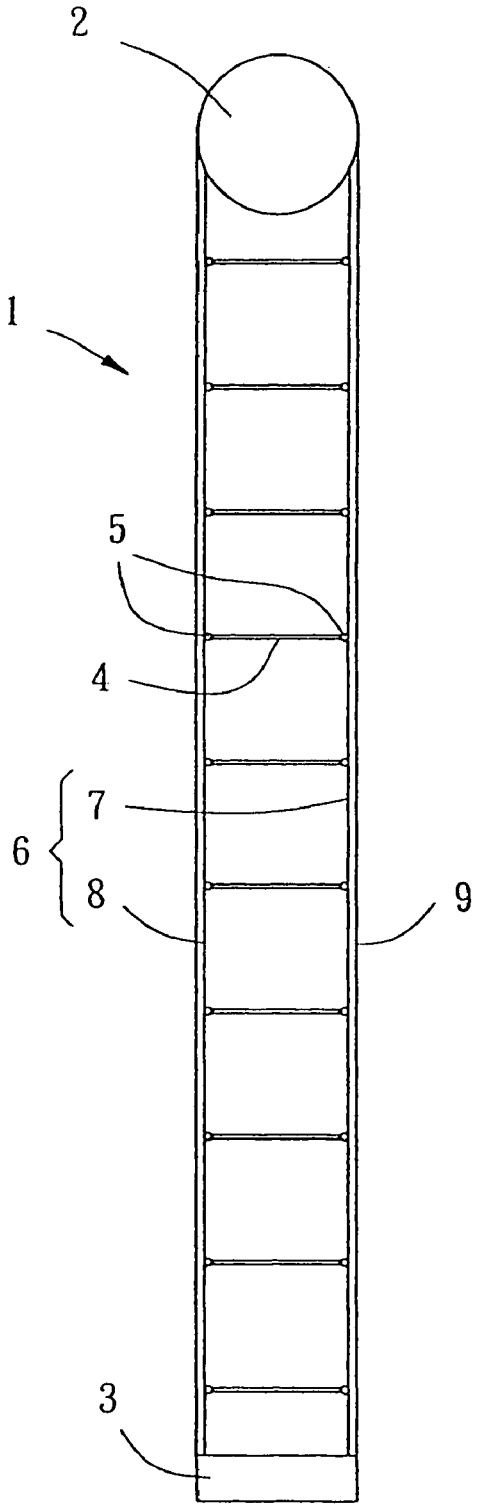
FIG. 1 PRIOR ART
FIG. 1 is a side view showing the fully extended status of a roller blind according to the prior art.
Figure 2:
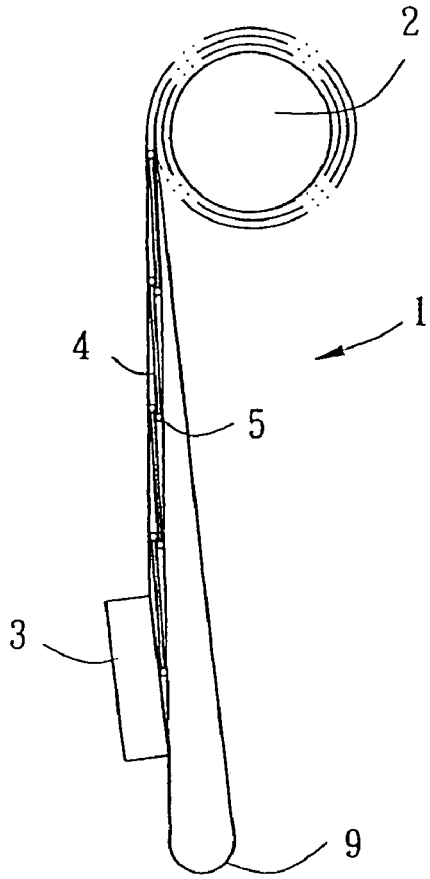
FIG. 2 PRIOR ART
FIG. 2 is a schematic side view of the received status of the prior art roller blind.

Referring to FIGS. 3–7, a fabric window blind 100 in accordance with the present invention is shown comprised of a head frame 10, a roller 20, a bottom rail 30, a plurality of slats 40, an adjustment mechanism 50, a shade 60, a lifting mechanism 70, and an antireverse member 80.

The head frame 10 is a narrow elongated box member affixed to the top side of a window defining a longitudinally extended receiving chamber 111 and a bottom opening 112 in communication with the receiving chamber 111.

The antireverse member 80, which is a check pawl in this embodiment, is formed of a spring plate suspended inside the receiving chamber 111, having a top end pivoted to the inside wall of the head frame 10 at the top side of the receiving chamber 111 and a bottom end terminating in a retaining tip 81. Because the check pawl 80 is not firmly affixed to the inside wall of the head frame 10, it can be biased upwards or downwards by an external force or forced downwards by the gravity weight thereof.

The roller 20 is a cylindrical member horizontally pivotally connected between two distal ends of the head frame 10 inside the receiving chamber 111, having a peripheral locating groove 21 for engagement with the retaining tip 81 of the check pawl 80.

The adjustment mechanism 50 comprises a control axle 51, an operating rod 53, and two cord member sets 52. The control axle 51 is horizontally pivotally mounted inside the receiving chamber 111 below the roller 20, having one end extended out of one end of the head frame 10. The operating rod 53 is coupled to the protruded end of the control axle 51 outside the head frame 10 through a worm gearing (not shown) such that the user can operate the operating rod 53 to bias the control axle 51. It is to be understood that a tilt cord, wired controller, or wireless remote controller may be used to substitute for the operating rod 53. The two cord member sets 52 are symmetrically disposed near two ends of the control axle 51, each comprising a front cord 521 and a rear cord 522. The front cord 521 and rear cord 522 of each cord member set 52 are respectively vertically disposed at the front and back sides of the slats 40, each having one end, namely, the top end respectively fastened to the periphery of the control axle 51 and the other end, namely, the bottom end vertically downwardly extended from the control axle 51 and connected to the bottom rail 30.

Figure 5:
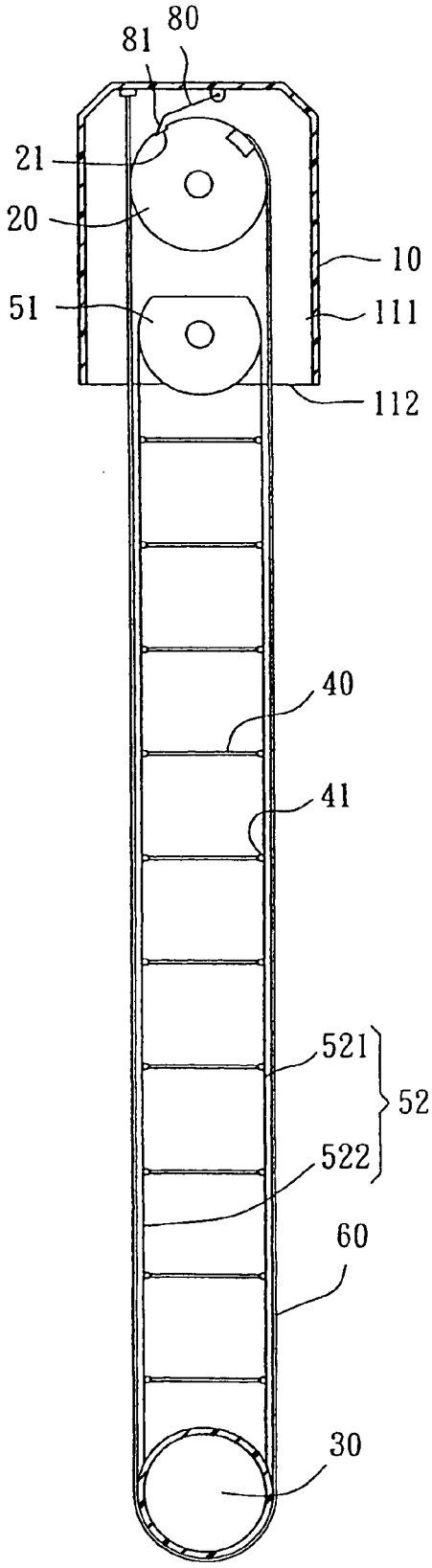
FIG. 5 is a side sectional view of the fabric window blind shown in FIG. 3, showing the fully extended status of the shade.

The slats 40 are narrow elongated fabric members, each having two opposite long sides hemmed and packed with a respective support rod 41. The two support rods 41 support the respective fabric slat 40 longitudinally in shape, allowing the respective fabric slat 40 to be curved in transverse direction. The front cord 521 and rear cord 522 of each cord member set 52 are respectively joined to the front and back sides of each slat 40 to hold the slats 40 in parallel at different elevations at an equal pitch below the control axle 51 (the front cord 521 and rear cord 522 of each cord member set 52 may be tied to the support rods 41 of each slat 40 or fastened to the front and rear sides of each slat 40 by means of any of a variety of conventional methods). As shown in FIG. 5, the slats 40 are arranged in parallel and vertically spaced from one another at an equal pitch. The pitch between each two adjacent slats 40 (i.e., the length of the part of the front cord 521 or rear cord 522 of each cord member set 52 between two slats 40) is slightly smaller than the length of the short sides of each slat 40.

Figure 3:
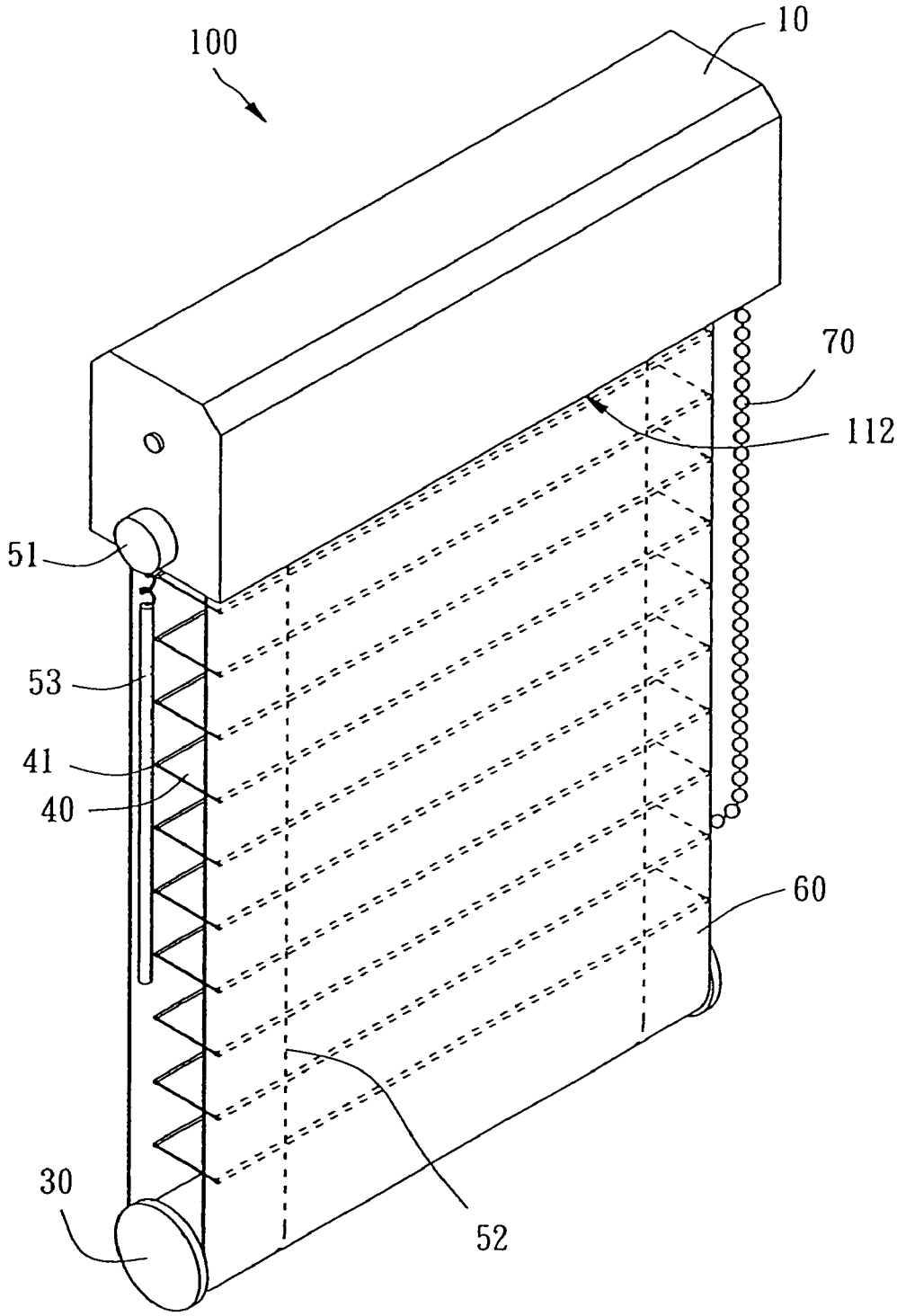
FIG. 3 is a perspective view of a fabric window blind according to a preferred embodiment of the present invention.
Figure 4:
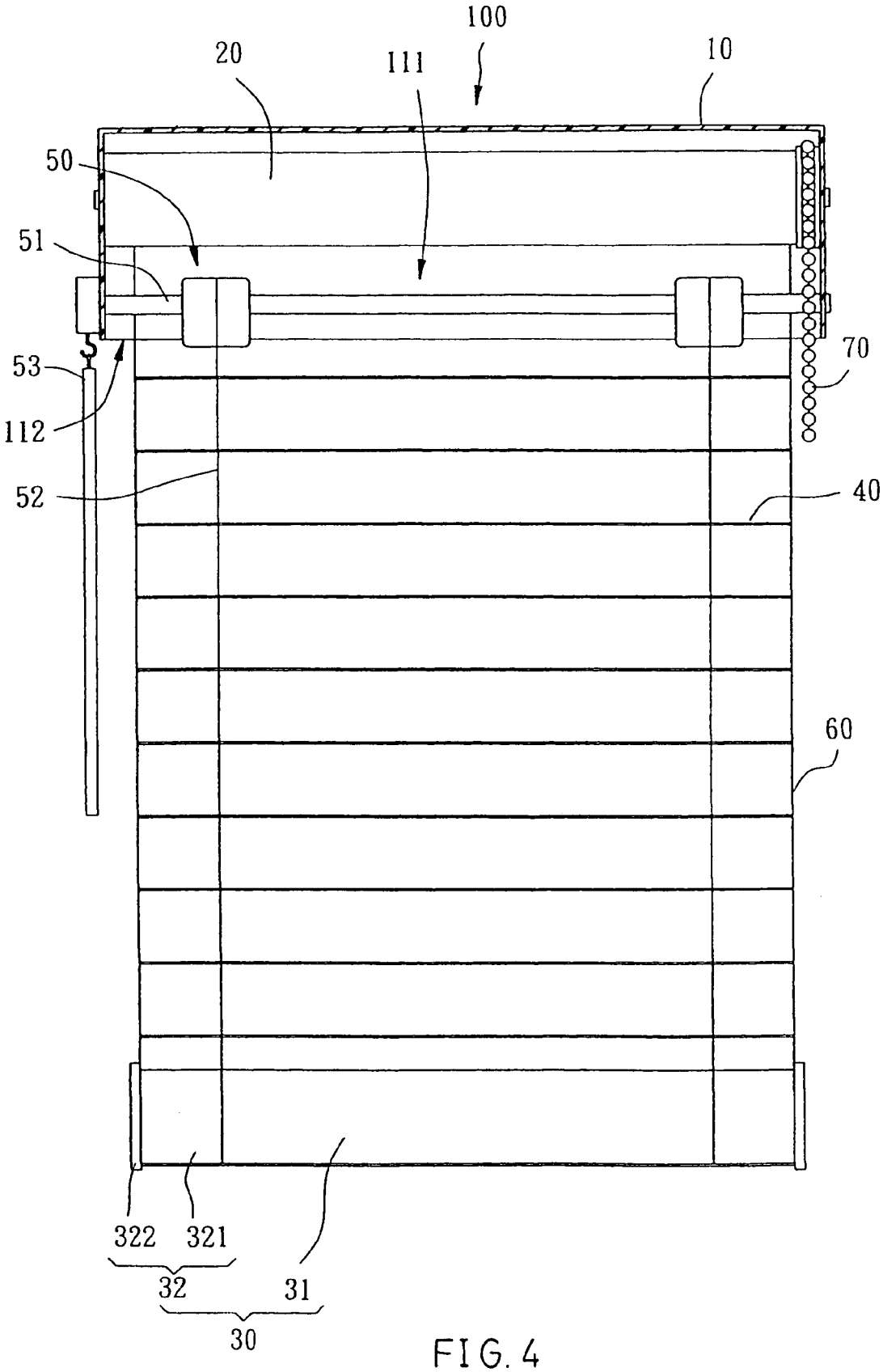
FIG. 4 is a front sectional view of the fabric window blind shown in FIG. 3.

The bottom rail 30 comprises a hollow cylindrical rail body 31 and two end caps 32. The hollow cylindrical rail body 31 is arranged in parallel to and below the slats 40, having a certain weight (according to this embodiment, the hollow cylindrical rail body 31 is made of metal). The two end caps 32 are respectively fastened to the two distal ends of the hollow cylindrical rail body 31. As shown in FIGS. 3 and 4, each end cap 32 comprising a cylindrical connecting portion, for example, a plug 321 press-fitted into one end of the hollow cylindrical rail body 31, and a cap head 322 stopped outside the hollow cylindrical rail body 31. The diameter of the cap head 322 is greater than the outer diameter of the hollow cylindrical rail body 31. The bottom ends of the front cord 521 and rear cord 522 of each cord member set 52 are respectively fastened to the periphery of the hollow cylindrical rail body 31 of the bottom rail 30.

The shade 60 is a thin rectangular sheet of gauze cloth that admits light. The length of the shade 60 is approximately twice the vertical height of the window. The width of the shade 60 is approximately equal to the transverse width of the window. The shade 60 is divided into two equal halves, namely, the front half and the rear half. The front half and rear half of the shade 60 have different light transmittance by means of different textural constructions provided at the front half and rear half of the shade (the front half has a relatively better light transmittance than the rear half). The shade 60 is extended over the bottom side of the hollow cylindrical body 31 of the bottom rail 30 between the cap heads 322 of the end caps 32, having one end fastened to the periphery of the roller 20 and the other end fastened to the inside wall of the head frame 10 inside the receiving chamber 111, as shown in FIG. 5. When installed, the front half and rear half of the shade 60 are respectively vertically stretched over the front and rear sides of the slats 40. Because the front half and rear half of the shade 60 have different light transmittance and are respectively vertically stretched over the front and rear sides of the slats 40, the shade 60 eliminates dazzle of light.

The lifting mechanism 70 is a chain-controlled lifting mechanism coupled to the roller 20 for operation by the user to rotate the roller 20, causing the roller 20 to roll up the shade 60 (alternatively, the lifting mechanism 70 can be operated by means of a lift cord, wired controller, or wireless remote controller).

The operation of the fabric window blind 100 is outlined hereinafter. When fully extended out, as shown in FIG. 5, the check pawl 80 is forced downwards by the gravity weight thereof to engage the retaining tip 81 into the peripheral locating groove 21 of the roller 20 to stop the roller 20 from backward (clockwise) rotation. At this time, the pivoted point between the check pawl 80 and the head frame 10 and the retaining tip 81 are respectively disposed at two sides relative to the vertical line passing through the center axis of the roller 20, i.e., the pivoted point between the check pawl 80 and the head frame 10 is relatively closer to the connection point between the shade 60 and the roller 20 and the retaining tip 81 is relatively closer to the connection point between the shade 60 and the head frame 10 (see FIG. 5). After engagement of the retaining tip 81 of the check pawl 80 into the peripheral locating groove 21 of the roller 20, the roller 20 is prohibited from backward rotation (the shade 60 cannot be rolled up clockwise) and can only be rotated forwards (counterclockwise) to roll up the shade 60.

Figure 6:
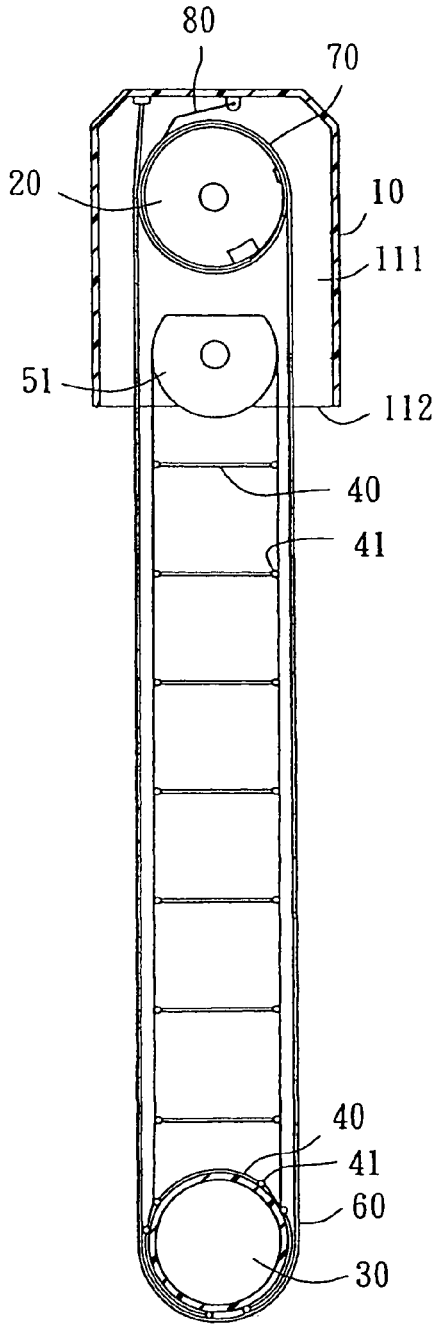
FIG. 6 is similar to FIG. 5 but showing the shade lifted.
Figure 7:
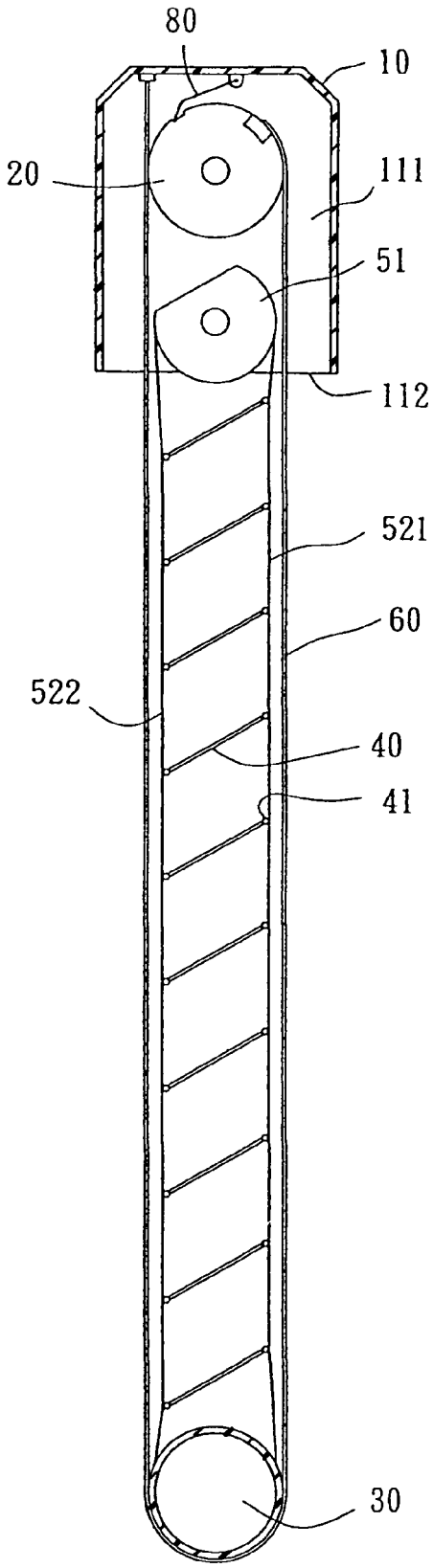
FIG. 7 is similar to FIG. 5 but showing the slats tilted.

When wishing to receive the fabric window blind 100 upwards, operate the lifting mechanism 70 to rotate the roller 20 forwards (counterclockwise) as shown in FIG. 6), causing the roller 20 to roll up the shade 60. During winding of one end of the shade 60 round the roller 20, the bottom rail 30 imparts a downward pressure to the shade 60, thereby producing a friction resistance between the shade 60 and the bottom rail 30, which friction resistance forces the bottom rail 30 to rotate in the same direction as the bottom rail 30 is carried upwards by the shade 60. At this time, the bottom rail 30 rolls up the cord member sets 52, and the slats 40 with the respective support rods 41 are received to the periphery of the bottom rail 30. Because the shade 60 is receivable to the roller 20 and the cord member sets 52 with the slats 40 are receivable to the bottom rail 30, it is not necessary to provide a wide transverse space in the head frame 10 for accommodating the received parts of the fabric window blind 100. Further, because the shade 60 and the cord member sets 52 with the slats 40 are separately receivable to the roller 20 and the bottom rail 30, receiving the window blind 100 does not cause the cord member sets 42 and the support rods 41 of the slats 40 to wrinkle the shade 60. Therefore, the shade 60 is maintained smooth when rolled up by the roller 20.

When wishing to extend out the fabric window blind 100 from the fully received position (the highest position) or any set position (the lifting mechanism 70 can lock the fabric window blind 100 in the desired elevational position, and the fabric window blind 100 does not fall when locked), operate the lifting mechanism 70 to rotate the roller 20 backwards (clockwise). At this time, the at least one turn of the shade 60 on the periphery of the roller 20 blocks the peripheral locating groove 21 and keeps the peripheral locating groove 21 of the roller 20 from touch of the retaining tip 81 of the check pawl 80, enabling the roller 20 to be rotated smoothly backwards (clockwise). Therefore, the roller 20 lets off the shade 60, and the bottom rail 30 is caused by the friction resistance between the periphery of the bottom rail 30 and the shade 60 to rotate in the same direction to let off the cord member sets 52 and the slats 40. After the shade 60 having been fully extended out of the roller 20, the peripheral locating groove 21 of the roller 20 is exposed to the outside and forced into engagement with the retaining tip 81 of the check pawl 80, and therefore the check pawl 80 stops the roller 20 from further backward rotation. Thus, the user knows that the shade 60 has been fully extended out.

When wishing to change the tilting angle of the slats 40, operate the operating rod 53 of the adjustment mechanism 50 to bias the control axle 51, thereby causing the control axle 51 to move the front cord 521 and the rear cord 522 of each cord member set 52 vertically in reversed directions (see FIG. 7), and therefore the slats 40 are tilted to the desired tilting angle. Because the slats 40 and the cord member sets 52 are not directly linked to the shade 60 (the slats 40 and the cord member sets 52 are coupled to the control axle 51, and the shade 60 is connected to the roller 20), the control axle 51 can be directly rotated to tilt the slats 40 either the shade 60 is fully extended out or set in any position. Therefore, the smoothly stretched shade 60 enhances the visual effect of the fabric window blind 100, and the slats 40 can be tilted to adjust the light transmittance of the fabric window blind 100.

Further, the two end caps 32 at the two distal ends of the hollow cylindrical rail body 31 of the bottom rail 30 are respectively stopped at two opposite lateral sides of the shade 60, maintaining the relative relationship between the shade 60 and the hollow cylindrical rail body 31 of the bottom rail 30, i.e., preventing falling of the hollow cylindrical rail body 31 of the bottom rail 30 out of the shade 60. Therefore, the shade 60 can smoothly be rolled up or extended out, and is kept in shape when moved.

In the aforesaid embodiment, the bottom rail 30 is comprised of the hollow cylindrical rail body 31 and the two end caps 32. Alternatively, the end caps can be formed integral with the hollow cylindrical rail body, i.e., the bottom rail can be directly molded from plastic material that has a certain gravity weight.

In the aforesaid embodiment, the shade 60 has one end fastened to the periphery of the roller 20 and the other end fastened to the inside wall of the head frame 10 inside the receiving chamber 111. Alternatively, the shade can be set having one end fastened to the outside wall of the head frame 10 and the other end fastened to the periphery of the roller 20, i.e., the two distal ends of the shade can be respectively fastened to the head frame and the roller at any suitable location.

As indicated above, the front and rear halves of the shade 60 have different light transmittance. During installation, the front half of the shade which has relatively higher light transmittance is set at the front side (facing the inside of the house), and the rear half of the shade which has relatively lower light transmittance is set at the back side (facing the outside of the house). Therefore, incident light from the outside of the house is filtered by the rear half of the shade 60 at first, and then the filtered incident light passes to the inside of the house through the front half of the shade 60 without dazzling the eyes of the people inside the house.

In general, the aforesaid roller 20, shade 60 and lifting mechanism 70 form a shade control system that controls the shading area of the shade 60; the aforesaid bottom rail 30, slats 40 and adjustment mechanism 50 form a slat control system that controls the tilting angle of the slats 40.

Figure 9:
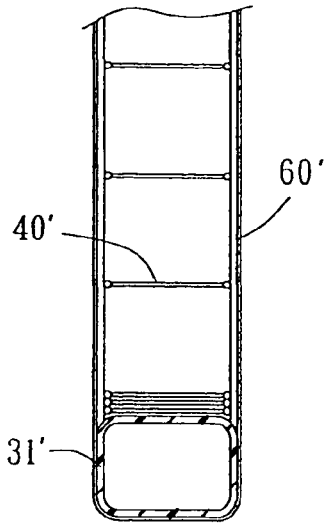
FIG. 9 is a sectional view of a part of the fabric window blind shown in FIG. 8, showing the shade lifted.
Figure 8:
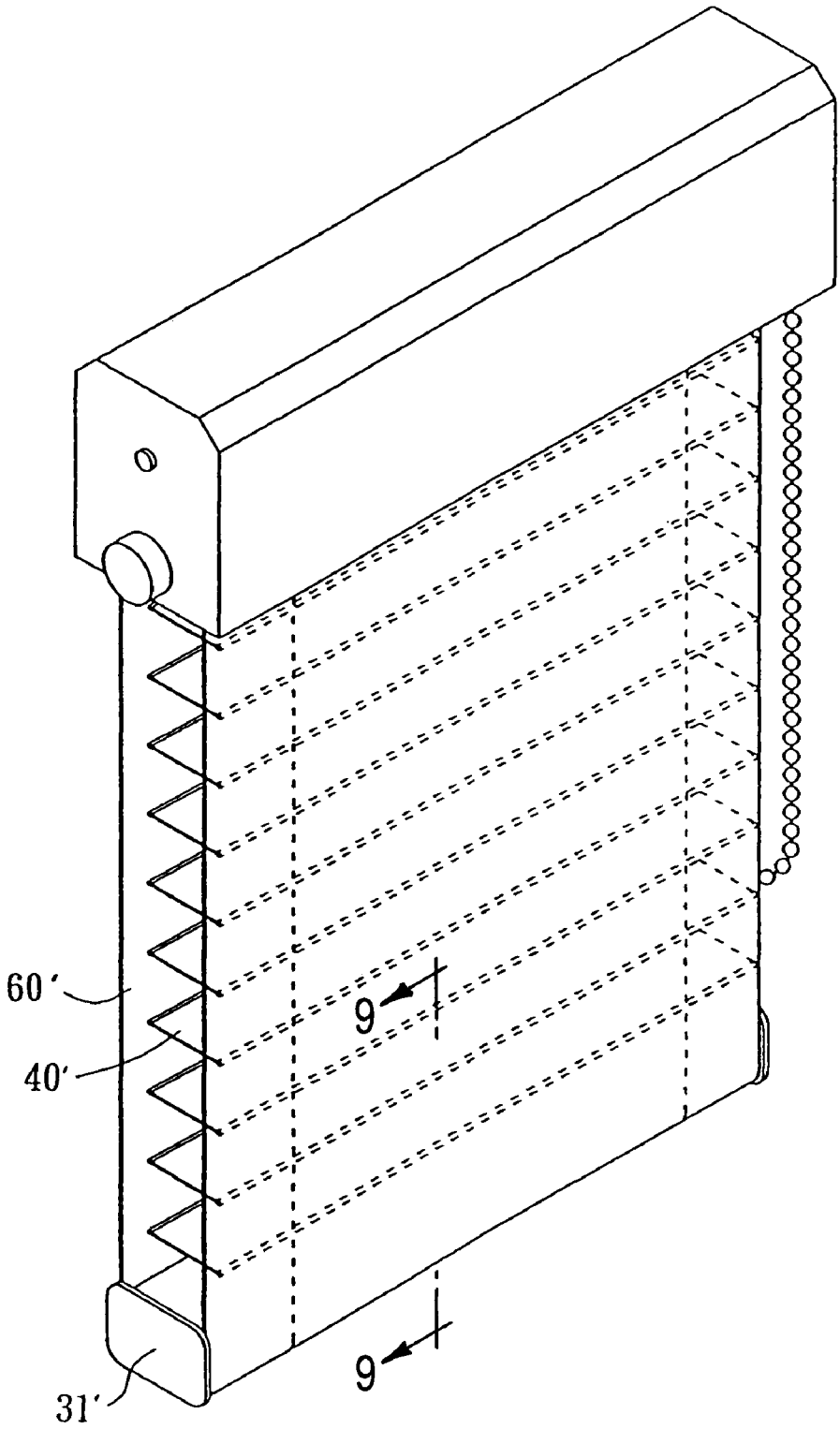
FIG. 8 is a perspective view of the fabric window blind according to another preferred embodiment of the present invention.

FIGS. 8 and 9 show an alternate form of the present invention. According to this embodiment, the bottom rail, referenced by 31', is shaped like a hollow, elongated, rectangular member, and relatively lighter in weight than the bottom rail of the aforesaid embodiment shown in FIGS. 3–7. Therefore, the friction resistance between the shade and the bottom rail according to this embodiment is relatively smaller, and the bottom rail is not forced by the shade 60' to rotate when lifting or lowering the bottom rail 31'. When lifting the shade 60', the slats 40' are gradually overlapped on one another at the bottom rail 31'. When lowering the shade 60', the slats 40' are released from the bottom rail 31' one after another. The bottom rails 31, 31' of the aforesaid two embodiments are of different designs, however they achieve the same effect. Further, the four corners of the rectangular bottom rail 31' may be smoothly chamfered as shown in FIG. 9 for lowering the friction generated between the bottom rail and the shade.

Further, in the aforesaid two embodiments, the shade control system comprising the roller, the shade and the lifting mechanism and the slat control system comprising the bottom rail, the salts and the adjustment mechanism are two independent mechanisms; however, the shade control system and the slat control system may be directly or indirectly coupled into a system, or, a master control system may be designed and used to control the shade control system and the slat control system.

What is claimed is:

1. A window blind comprising:

a head frame horizontally affixed to a top side of a window;

a roller horizontally rotatably mounted inside said head frame;

an adjustment mechanism having a control axle horizontally pivotally mounted inside said head frame below said roller, and two cord member sets having top ends connected to said control axle and bottom ends vertically downwardly suspended from said control axle;

a plurality of slats arranged in parallel at different elevations below said control axle, said slats each having two opposite lateral sides respectively joined to said cord member sets;

a bottom rail fastened to said bottom ends of the cord member sets below said slats; and a light-admitting shade having a first end fastened to said head frame, and a second end extended downwardly over said bottom rail and turned upwards toward said head frame and fastened to said roller.

2. The window blind as claimed in claim 1, wherein said bottom rail is pressed on said shade.

3. The window blind as claimed in claim 1, wherein said head frame comprises a longitudinally extended receiving chamber for accommodating said roller and said control axle of said adjustment mechanism, and a bottom opening in communication with said receiving chamber for the passing of said shade and said cord member sets.

4. The window blind as claimed in claim 1, further comprising an antireverse member mounted inside said head frame for keeping said roller rotatable only in one direction.

5. The window blind as claimed in claim 4, wherein said antireverse member has a top end connected to said head frame and a bottom end terminating in a retaining tip; said roller has a locating groove in engagement with the retaining tip of said antireverse member.

6. The window blind as claimed in claim 5, wherein said antireverse member is formed of a spring plate.

7. The window blind as claimed in claim 5, wherein said retaining tip extends from said top end of said antireverse member at an angle.

8. The window blind as claimed in claim 5, wherein said antireverse member is pivotally mounted to said head frame.

9. The window blind as claimed in claim 1, wherein said bottom rail is a cylindrical member.

10. The window blind as claimed in claim 9, wherein said bottom rail has a predetermined gravity weight and is pressed on said shade to produce a friction resistance such that said bottom rail is rotated when rotating said roller to roll up said shade.

11. The window blind as claimed in claim 1, wherein said bottom rail comprises a cylindrical rail body, and two end caps fastened to two distal ends of said cylindrical rail body, said end caps each comprising a connecting portion fastened to said cylindrical rail body, and a cap head disposed outside said cylindrical rail body, said cap head having a diameter greater than that of said cylindrical rail body.

12. The window blind as claimed in claim 11, wherein said cylindrical rail body is a hollow cylindrical member; the connecting portions of said end caps are respectively press-fitted into two distal ends of said cylindrical rail body.

13. The window blind as claimed in claim 1, wherein said slats are fabric slats each having two hemmed long sides respectively mounted with a respective support rod.

14. The window blind as claimed in claim 1, wherein said control axle has one end extended out of said head frame for operation by a user.

15. The window blind as claimed in claim 1, wherein said slats are arranged in parallel at different elevations at an equal pitch, each having two opposite long sides and two opposite short sides; the pitch between each two adjacent slats is slightly smaller than the length of the short sides of said slats.

16. The window blind as claimed in claim 1, wherein said bottom rail comprises a cylindrical rail body and two end caps respectively fastened to two distal ends of said cylindrical rail body, said end caps each having an outer diameter greater than that of said cylindrical rail body; said shade has a part extended over said cylindrical rail body of said bottom rail at a bottom side and disposed between said end caps.

17. The window blind as claimed in claim 1, further comprising a lifting mechanism coupled to said roller for operation by a user to rotate said roller and to stop said roller in position.

18. The window blind as claimed in claim 1, wherein said shade comprises a longitudinally extended first half and a longitudinally extended second half, said first half and said second half having different light transmittance.

19. The window blind as claimed in claim 1, wherein said bottom rail is an elongated, rectangular member pressed on said shade such that said bottom rail is moved upwards with said shade and said slats are received on a top side of said bottom rail one above another when rotating said roller to roll up said shade; said bottom rail is lowered with said shade and said slats are released from said bottom rail one after another when rotating said roller to let off said shade.

20. A window blind comprising:

a head frame affixed to a top side of a window;

a shade control system comprising a roller horizontally rotatably mounted inside said head frame, and a shade having a first end fastened to said head frame, and a second end fastened to said roller such that said roller rolls up and extends out said shade upon rotation of said roller; and a slat control system comprising a bottom rail suspended below said roller and pressed on said shade, a plurality of slats arranged at different elevations between said roller and said bottom rail, and an adjustment mechanism supporting said slats between said roller and said bottom rail, said bottom rail receiving and extending out said slats upon rotation of said roller.

21. The window blind as claimed in claim 20, wherein said shade control system further comprises a lifting mechanism coupled to said roller for operation by a user to rotate said roller and to stop said roller in position.

22. The window blind as claimed in claim 20, wherein said bottom rail is a cylindrical member pressed on said shade such that said bottom rail is moved upwards and rotated in one direction to receive said slats on a periphery thereof when said roller is rotated to roll up said shade; said bottom rail is lowered and rotated in a reversed direction to release said slats from the periphery thereof when said roller is rotated to extend out said shade.

23. The window blind as claimed in claim 20, wherein said bottom rail is an elongated, rectangular member pressed on said shade such that said bottom rail is moved upwards and said slats are received on a top side of said bottom rail one above another when said roller is rotated to roll up said shade; said bottom rail is lowered and said slats are released from said bottom rail one after another when said roller is rotated to extend out said shade.

24. The window blind as claimed in claim 20, wherein said adjustment mechanism comprises a control axle horizontally pivotally mounted inside said head frame between said roller and said slats, and a plurality of cord member sets vertically arranged at two sides and respectively connected between said control axle and said bottom rail and joined to two opposite long sides of each said slat to hold said slats at different elevations between said roller and said bottom rail.

* * * * *